US010890867B2

(12) United States Patent
Suwama

(10) Patent No.: US 10,890,867 B2
(45) Date of Patent: Jan. 12, 2021

(54) IMAGE FORMING APPARATUS CAPABLE OF INCREASING GLOSS OF AN IMAGE

(71) Applicant: KONICA MINOLTA, INC., Tokyo (JP)

(72) Inventor: Dai Suwama, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/751,335

(22) Filed: Jan. 24, 2020

(65) Prior Publication Data

US 2020/0278625 A1 Sep. 3, 2020

(30) Foreign Application Priority Data

Mar. 1, 2019 (JP) ..... 2019-037952

(51) Int. Cl.
*G03G 15/20* (2006.01)

(52) U.S. Cl.
CPC ..... *G03G 15/205* (2013.01); *G03G 15/2064* (2013.01); *G03G 2215/2009* (2013.01)

(58) Field of Classification Search
CPC ..... G03G 15/2028; G03G 15/205; G03G 15/2064
USPC ..... 399/67, 68, 341
See application file for complete search history.

(56) References Cited

U.S. PATENT DOCUMENTS

| | | | | |
|---|---|---|---|---|
| 9,952,549 | B2 | 4/2018 | Shimomura et al. | |
| 9,989,906 | B2 * | 6/2018 | Yoshie et al. ..... | G03G 15/2064 |
| 10,054,886 | B2 | 8/2018 | Maeda et al. | |
| 10,663,901 | B2 * | 5/2020 | Shirodai et al. ... | G03G 15/2064 |

FOREIGN PATENT DOCUMENTS

JP 2018097118 A 6/2018

* cited by examiner

*Primary Examiner* — William J Royer
(74) *Attorney, Agent, or Firm* — Holtz, Holtz & Volek PC

(57) ABSTRACT

An image forming apparatus includes an image former which forms an image on a recording medium, a pressure member, a fixing member which is pressed against the pressure member to form a nip portion and comes into contact with the image formed on the recording medium conveyed at the nip portion, and a hardware processor. The hardware processor causes one member, either the pressure member or the fixing member, to function as a driving member which conveys the recording medium in a normal mode and causes the other member of the pressure member and the fixing member to perform an assist operation for reducing torque of the driving member compared to the normal mode to increase gloss of the image in a high-gloss mode.

14 Claims, 7 Drawing Sheets

FIG.6
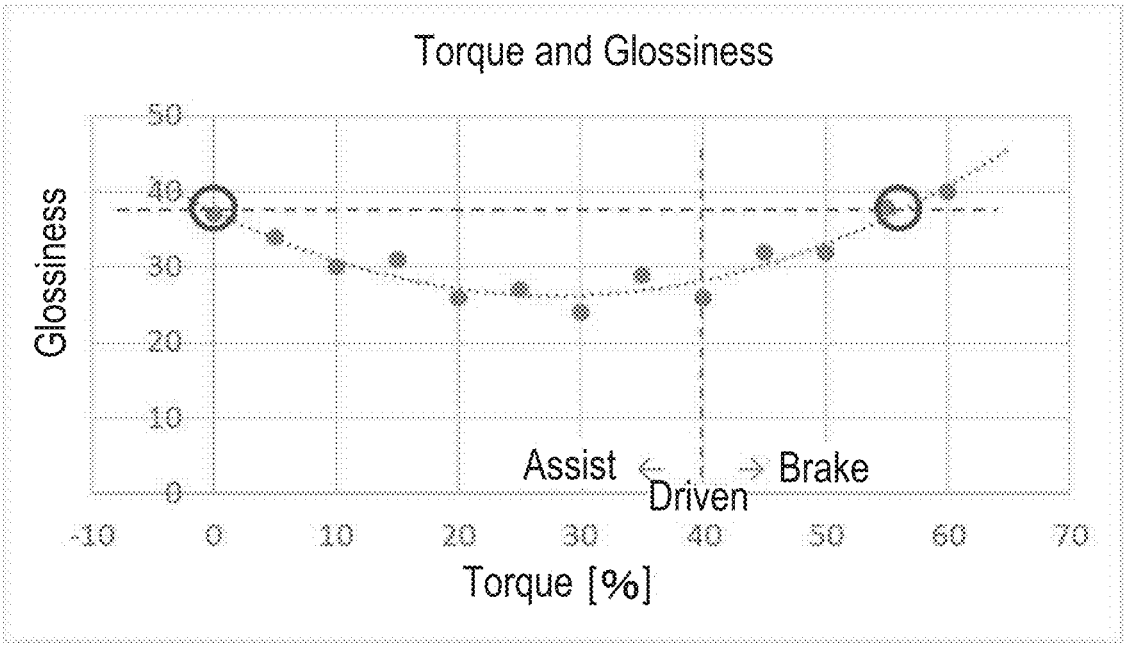
FIG.7
| | Gloss | Density Unevenness | Crease | Separability |
|---|---|---|---|---|
| Large Assist | High | Good | Good | Bad |
| Small Assist | Low | Good | Good | Bad |
| Driven | Medium | Average | Average | Average |
| Brake | High | Bad | Bad | Good |
FIG.8
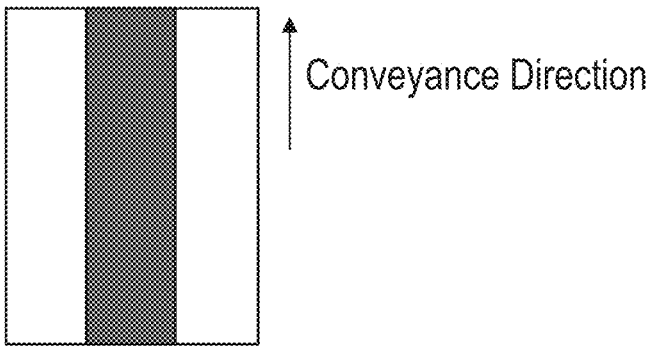

| | Gloss | Density Unevenness | Crease | Separability |
|---|---|---|---|---|
| Large Assist 2 | High | Bad | Bad | Good |
| Small Assist 2 | Low | Average | Average | Average |
| Driven 2 | Medium | Average | Average | Average |
| Brake 2 | High | Good | Good | Bad |

IMAGE FORMING APPARATUS CAPABLE OF INCREASING GLOSS OF AN IMAGE

CROSS-REFERENCE TO RELATED APPLICATION

Japanese Patent Application No. 2019-037952 filed on Mar. 1, 2019, including description, claims, drawings, and abstract the entire disclosure is incorporated herein by reference in its entirety.

BACKGROUND

1. Technological Field

The present invention relates to an image forming apparatus.

2. Description of the Related Art

In a conventional electrophotographic image forming apparatus, an image is formed on a paper sheet by forming a toner image on the paper sheet and fixing the toner image on the paper sheet by a fixing device included in the image forming apparatus. The fixing device, for example, fixes the toner image onto the paper sheet by conveying the paper sheet by rotations of two rollers while applying pressure and heat to the paper sheet at a fixing nip formed by pressing the rollers against each other.

There are known technologies which control the gloss of the image formed on the paper sheet by such a fixing device. For example, there are technologies which increase the gloss by (1) rising the fixing temperature, (2) increasing the fixing nip pressure, and (3) performing rapid cooling after the application of pressure and heat. However, in the technologies of (1), (2), there is a limit to a set value of the fixing temperature or the like in terms of the durability or the like of the fixing device. Further, there is a side effect such as a rough image due to an excessive fixing property. In the technology of (3), there are problems of space and cost due to the necessity of a cooling device.

On the other hand, Unexamined Japanese Patent Publication No. 2018-97118 discloses the following prior art. An upper pressure roller which faces the upper face of the paper sheet and a lower pressure roller which has a higher hardness than the upper pressure roller are pressed against each other to form the fixing nip, and control is performed so that the linear speed of the lower pressure roller becomes higher than the linear speed of the upper pressure roller. Accordingly, the nip width of the fixing nip is increased to increase the glossiness of the image on the paper sheet.

SUMMARY

However, the above prior art has a problem of side effects such as the occurrence of a crease on the paper sheet depending on conditions.

The present invention has been made to solve such a problem. Specifically, it is an object of the present invention to provide the image forming apparatus capable of increasing the gloss of the image on a recording medium while preventing side effects such as the occurrence of the crease on the recording medium.

To achieve at least one of the abovementioned objects, according to an aspect of the present invention, an image forming apparatus includes an image former which forms an image on a recording medium, a pressure member, a fixing member which is pressed against the pressure member to form a nip portion and comes into contact with the image formed on the recording medium conveyed at the nip portion, and a hardware processor which causes one member, either the pressure member or the fixing member, to function as a driving member which conveys the recording medium in a normal mode and causes the other member of the pressure member and the fixing member to perform an assist operation for reducing torque of the driving member compared to the normal mode to increase gloss of the image in a high-gloss mode.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

FIG. 4 is a diagram illustrating the simplified configuration of the fixer including motors for rotating a fixing roller and a pressure roller and the like;

FIG. 6 is a graph illustrating a measurement result of the relationship between the torque of the pressure roller and glossiness;

FIG. 7 is a diagram illustrating an evaluation result of the increase in the gloss and side effects for each of a driven operation, an assist operation, and a brake operation of the fixing roller as a non-driving member;

FIG. 8 is a diagram illustrating an example of an image having a relatively high possibility of the occurrence of a paper crease when the gloss is increased by a brake mode;

DETAILED DESCRIPTION OF EMBODIMENTS

Figure 1:
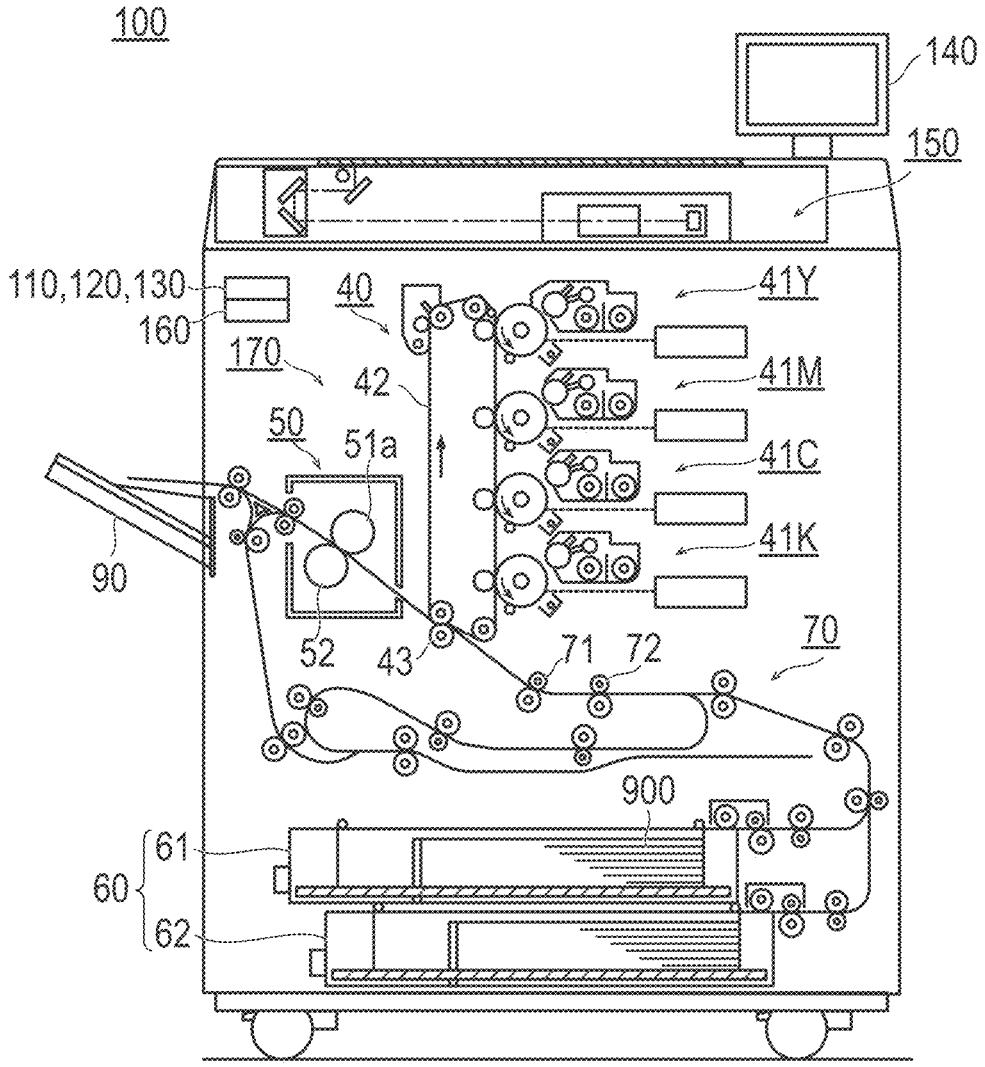
FIG. 1 is a schematic diagram illustrating the configuration of an image forming apparatus.

Hereinafter, one or more embodiments of the present invention will be described with reference to the drawings. However, the scope of the invention is not limited to the disclosed embodiments.

Hereinafter, an image forming apparatus 100 according to an embodiment of the present invention will be described with reference to the drawings. In the description of the drawings, the same elements are denoted by the same reference numerals, and redundant description is omitted. In addition, in some cases, dimensional ratios in the drawings are exaggerated and different from actual ratios for convenience of the description.

Figure 2:
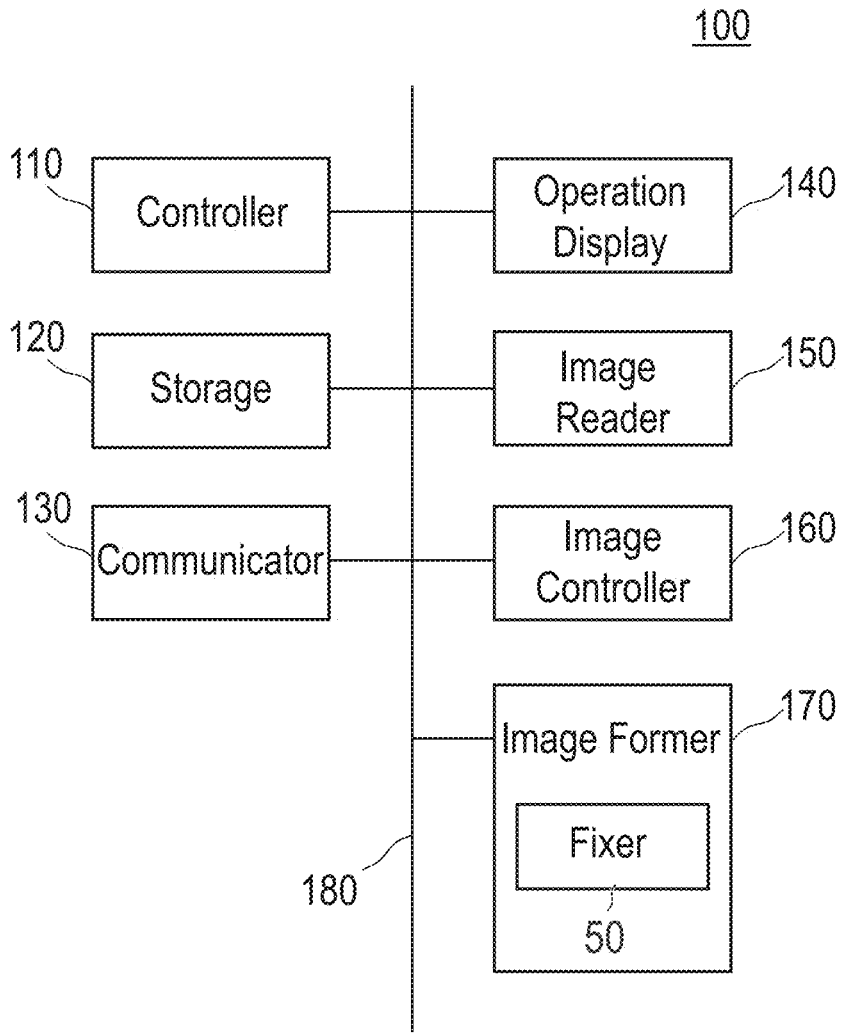
FIG. 2 is a block diagram illustrating the configuration of the image forming apparatus.

FIG. 1 is a schematic diagram illustrating the configuration of the image forming apparatus 100. FIG. 2 is a block diagram illustrating the configuration of the image forming apparatus 100.

The image forming apparatus 100 includes a controller 110, a storage 120, a communicator 130, an operation display 140, an image reader 150, an image controller 160, and an image former 170. These constituent elements are connected through a bus 180 communicably with each other. The image forming apparatus 100 can include an MFP (Multifunction Peripheral).

The controller 110 is provided with a CPU (Central Processing Unit) and various memories, and performs control of each of the above elements and various arithmetic processes in accordance with programs. Details of the action of the controller 110 will be described later.

The storage 120 includes an SSD (Solid State Drive), an HDD (Hard Disc Drive), or the like, and stores various programs and various pieces of data.

The communicator 130 is an interface for performing communication between the image forming apparatus 100 and an external device. Network interfaces based on standards such as Ethernet (registered trademark), SATA, and IEEE1394 are used as the communicator 130. Further, various local connection interfaces such as wireless communication interfaces such as Bluetooth (registered trademark), IEEE802.11, and the like are used as the communicator 130.

The operation display 140 is provided with a touch panel, a numeric keypad, a start button, a stop button, and the like, and used for displaying various pieces of information and inputting various instructions.

The image reader 150 includes a light source such as a fluorescent lamp and an image sensor such as a CCD (Charge Coupled Device) image sensor. The image reader 150 applies light from the light source to a document set at a predetermined reading position, photoelectrically converts reflected light by the image sensor, and generates image data from the electric signal.

The image controller 160 performs a layout process and a rasterize process on print data which is included in a print job received by the communicator 130 or the like to generate image data in the bitmap format.

The print job is a general term for print commands to the image forming apparatus 100, and includes print data and print setting. The print data is data of a document to be printed. The print data can include, for example, various pieces of data such as image data, vector data, and text data. Specifically, the print data can be PDL (Page Description Language) data, PDF (Portable Document Format) data, or TIFF (Tagged Image File Format) data. The print setting is setting relating to image formation on a paper sheet 900. The print setting can include, for example, various settings such as setting of the number of pages, setting of the number of print sets, setting of a paper type, setting of color or monochrome selection, and setting of page layout. The print setting can further include setting of a high-gloss mode.

The image former 170 includes an image generator 40, a fixer 50, a paper feeder 60, and a paper sheet conveyor 70.

The image generator 40 includes image generation units 41Y, 41M, 41C, and 41K respectively corresponding to toner of Y (yellow), M (magenta), C (cyan), and K (black) colors. Each of the image generation units 41Y, 41M, 41C, 41K forms a toner image on a photosensitive drum on the basis of image data through processes of electrostatic charge, exposure, and development. The exposure is performed by scanning the photosensitive drum with laser light. The toner images formed on the photosensitive drum are sequentially superimposed on an intermediate transfer belt 42, and transferred onto the paper sheet 900 by a secondary transfer roller 43.

The fixer 50 includes a fixing roller 51*a* and a pressure roller 52. The fixing roller 51*a* and the pressure roller 52 are pressed against each other to form a fixing nip N (refer to FIG. 3A) between the fixing roller 51*a* and the pressure roller 52. The fixing roller 51*a* constitutes a fixing member which comes into contact with an unfixed toner image at the fixing nip N. The pressure roller 52 constitutes a pressure member. A fixing belt 51*b* (refer to FIG. 3B) may be used, and the fixing roller 51*a*, which is disposed on the inner peripheral face of the fixing belt 51*b*, and the pressure roller 52 may be pressed against each other through the fixing belt 51*b* to form the fixing nip N between the fixing belt 51*b* and the pressure roller 52. In this case, the fixing belt 51*b* constitutes the fixing member. Hereinbelow, description will be made assuming that the paper sheet 900 is conveyed with the front face of the paper sheet 900 with the toner image formed thereon facing the fixing roller 51*a*.

Figure 3A:
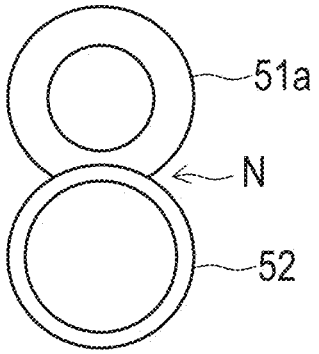
FIG. 3A and FIG. 3B are diagrams illustrating the simplified configuration of a fixer.
Figure 3B:
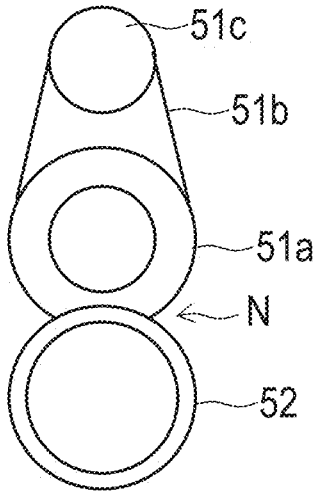

FIG. 3A and FIG. 3B are diagrams illustrating the simplified configuration of the fixer 50.

In FIG. 3A the configuration of the fixer 50 including the fixing roller 51*a* and the pressure roller 52 is illustrated. In this example, the fixing roller 51*a* and the pressure roller 52 are pressed against each other to form the fixing nip N. The fixing roller 51*a*, for example, includes a core metal which is made of metal such as iron and coated with an elastic layer. For example, heat-resistant silicon rubber can be used as the elastic layer. The elastic layer may have a configuration in which heat-resistant silicon rubber is coated with PTFE (polytetrafluoroethylene), which is a heat-resistant resin. The pressure roller 52, for example, includes a base material of PI (polyimide) whose outer peripheral face is coated with an elastic layer. For example, heat-resistant silicon rubber can be used as the elastic layer. The elastic layer may have a configuration in which heat-resistant silicon rubber is coated with a PFA (perfluoroalkoxy) tube as a surface release layer.

In FIG. 3B the configuration of the fixer 50 including the fixing roller 51*a*, the fixing belt 51*b*, and the pressure roller 52 is illustrated. In this example, the fixing roller 51*a* and the pressure roller 52 are pressed against each other through the fixing belt 51*b* to form the fixing nip N between the fixing belt 51*b* and the pressure roller 52. The fixing belt 51*b* can have a configuration in which the outer peripheral face of a base material of PI is coated with heat-resistant silicon rubber as an elastic layer and further coated with a PFA tube, which is a heat-resistance resin.

Hereinbelow, a case where the fixing belt 51*b* is not used will be described as an example unless otherwise specifically noted.

Figure 4:
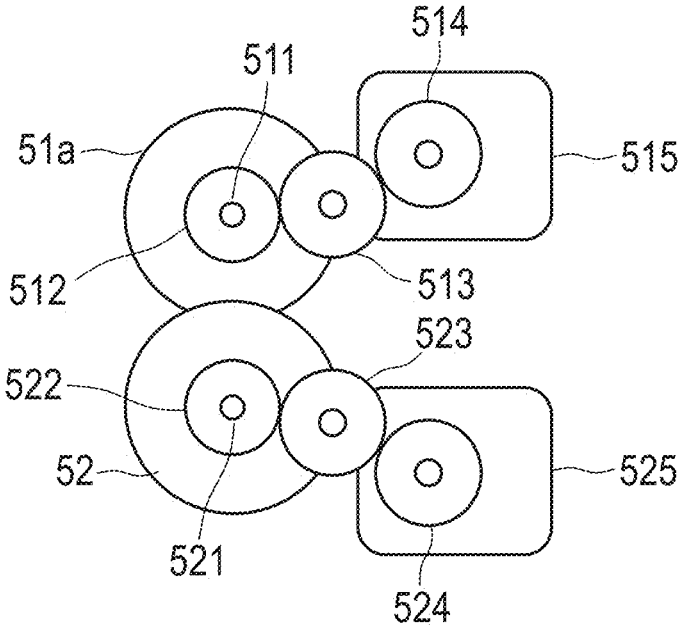

FIG. 4 is a diagram illustrating the simplified configuration of the fixer 50 including motors for rotating the fixing roller 51*a* and the pressure roller 52 and the like.

The fixing roller 51*a* is connected to a first motor 515 as a driving source. Specifically, a gear 512, which is disposed on a rotation shaft of the fixing roller 51*a*, meshes with an intermediate gear 513, and the intermediate gear 513 meshes with a gear 514, which is disposed on a rotation shaft of the first motor 515. Accordingly, torque of the first motor 515 is transmitted to the fixing roller 51*a*.

The pressure roller 52 is connected to a second motor 525 as a driving source. Specifically, a gear 522, which is disposed on a rotation shaft of the pressure roller 52, meshes with an intermediate gear 523, and the intermediate gear 523 meshes with a gear 524, which is disposed on a rotation shaft of the second motor 525. Accordingly, torque of the second motor 525 is transmitted to the pressure roller 52.

The fixing roller 51*a* and the pressure roller 52 are controlled to rotate at a predetermined linear speed (rotation speed) by the torque transmitted from the first motor 515 and the torque transmitted from the second motor 525, respectively.

A first heating source 511 is incorporated in the fixing roller 51*a*. The first heating source 511 is, for example, a halogen heater. The fixing roller 51*a* is heated to a predetermined fixing temperature with heat generated by the first heating source 511. Note that, in the case of the fixer 50 described above including the fixing roller 51*a*, the fixing belt 51*b*, and the pressure roller 52, a heating source is incorporated in a heating roller 51*c* (refer to FIG. 3B). The heating source is, for example, a halogen heater. The fixing belt 51*b*, which is stretched on the heating roller 51*c*, is heated by the heating source through the heating roller 51*c*. The heating roller 51*c* can have a configuration in which the outer peripheral face of a cylindrical core metal made of aluminum or the like is coated with PTFE.

A second heating source 521 is incorporated in the pressure roller 52. The second heating source 521 is, for example, a halogen heater. The pressure roller 52 is heated to a predetermined fixing temperature with heat generated by the second heating source 521.

The fixer 50 fuses and fixes (hereinbelow, also merely referred to as "fix") the toner image on the paper sheet 900 onto the front face of the paper sheet 900 by applying heat and pressure to the paper sheet 900 conveyed to the fixing nip N at the fixing nip N and rotating the fixing roller 51*a* and the pressure roller 52 by the configuration described above.

The paper sheet 900 with the toner image fixed thereon by the fixer 50 is ejected as a printed matter to a paper output tray 90.

The paper feeder 60 includes a plurality of paper feed trays 61, 62 and feeds the paper sheets 900 stored in the paper feed trays 61, 62 one by one to a conveyance path on the downstream side.

The paper sheet conveyor 70 includes a plurality of conveyance rollers for conveying the paper sheet 900 and conveys the paper sheet 900 between the paper feeder 60, the image generator 40, and the fixer 50. The conveyance rollers include a resist roller 71 for correcting the inclination of the paper sheet 900 and a loop roller 72 for forming a predetermined amount of loop on the paper sheet 900.

The paper sheet conveyor 70 ejects the paper sheet 900 with an image formed thereon to the paper output tray 90.

Details of the action of the controller 110 will be described.

The controller 110 is capable of controlling the fixer 50 to operate in a normal mode in which control for increasing the gloss of the image formed on the paper sheet 900 (hereinbelow, also merely referred to as the "gloss") is not performed and to operate in a high-gloss mode in which the control for increasing the gloss is performed.

The controller 110 causes one roller, either the fixing roller 51*a* or the pressure roller 52, to function as a member which conveys the paper sheet 900 in the normal mode (hereinbelow, referred to as the "driving member"). The controller 110 causes the other roller (hereinbelow, referred to as the "non-driving member") of the fixing roller 51*a* and the pressure roller 52 to perform an assist operation for reducing the torque of the driving member compared to the normal mode or a brake operation for increasing the torque of the driving member compared to the normal mode in the high-gloss mode. The driving member controls a conveyance speed of the paper sheet 900 in the fixer 50.

The controller 110 can cause the non-driving member to rotate following the driving member by not transmitting torque to the non-driving member in the normal mode. Note that, in the normal mode, torque may be transmitted to the non-driving member to rotate the non-driving member at a linear speed equal to that of the driving member.

In the high-gloss mode, the controller 110 causes the fixer 50 to perform the assist operation or the brake operation according to a predetermined condition to increase the gloss as described later. In the assist operation, the linear speed of the non-driving member is made higher than the linear speed of the driving member. In the brake operation, the linear speed of the non-driving member is made lower than the linear speed of the driving member.

Figure 5:
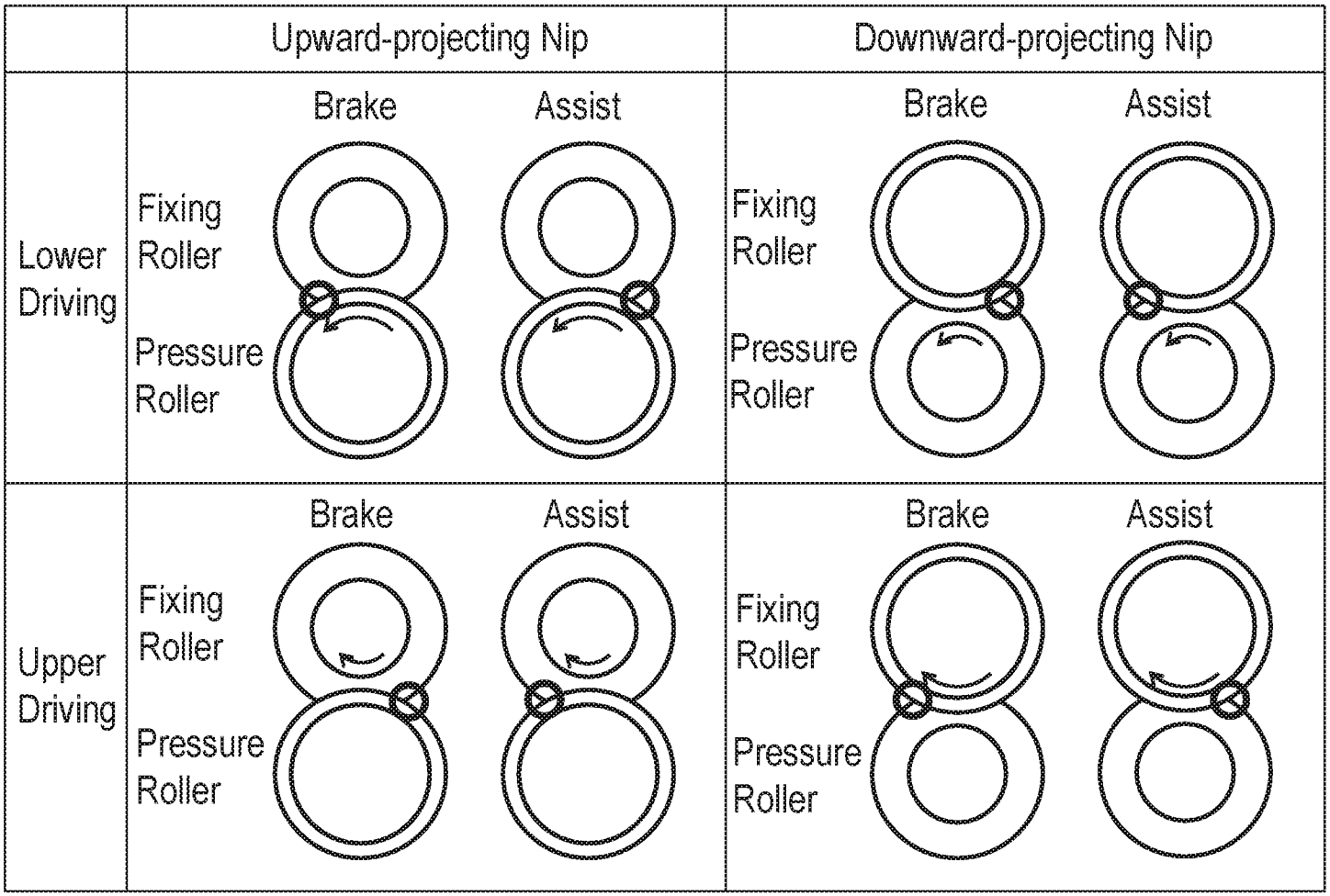
FIG. 5 is an explanatory diagram for describing influences of the selection of a driving member, the shape of a fixing nip, and a pressure rise position in the fixing nip on the conveyance stability of a paper sheet, the separability of the paper sheet after fixing, and an increase in gloss.

FIG. 5 is an explanatory diagram for describing influences of the selection of the driving member, the shape of the fixing nip N, and a pressure rise position in the fixing nip N on the conveyance stability of the paper sheet 900, the separability of the paper sheet 900 after fixing, and an increase in the gloss. As described above, the paper sheet 900 is conveyed with the front face of the paper sheet 900 with the toner image formed thereon facing the fixing roller 51*a*. In FIG. 5, "Lower Driving" indicates that the pressure roller 52 functions as the driving member, and "Upper Driving" indicates that the fixing roller 51*a* functions as the driving member. Further, "Upward-Projecting Nip" indicates that the pressure roller 52 bites into the fixing roller 51*a* so that the shape of the fixing nip N projects toward the fixing roller 51*a*. Further, "Downward-Projecting Nip" indicates that the fixing roller 51*a* bites into the pressure roller 52 so that the shape of the fixing nip N projects toward the pressure roller 52. Further, a position in the fixing nip N where a pressure rise is remarkable in the assist operation and the brake operation (the pressure rise position) is indicated by a thick-line circle.

In regard to the conveyance stability of the paper sheet 900, the paper sheet 900 is preferably conveyed with the back face of the paper sheet 900, which does not come into contact with an unfixed image (toner image) formed on the front face of the paper sheet 900, brought into contact with the driving member. That is, in FIG. 5, the lower driving is preferred. This is because, if a conveyance driving force is applied to the paper sheet 900 through the toner of the image, the conveyance of the paper sheet 900 becomes unstable due to the presence of the toner.

In regard to the separability of the paper sheet 900 from the fixing roller 51*a* after fixing (hereinbelow, also merely referred to as the "separability"), the fixing nip N is preferably formed in a shape that allows the front face with the image formed thereon of the paper sheet 900 nipped by the fixing nip N to have a projecting shape. That is, in FIG. 5, the upward-projecting nip is preferred. This is because, since the front face with the toner image formed thereon and the fixing roller 51*a*, which comes into contact with the front face, tend to adhere to each other, the separability of the paper sheet 900 after fixing is improved when the paper sheet 900 is warped in the direction away from the fixing roller 51*a*.

In regard to the increase in the gloss, when the pressure rise position in the fixing nip N is on the downstream side in the conveyance direction of the paper sheet 900, the gloss is relatively more likely to increase. Further, the gloss is relatively less likely to increase in the assist operation. Thus, in the assist operation, a condition with the lower driving and the upward-projecting nip and a condition with the upper driving and the projecting nip under which the pressure rise position in the fixing nip N is on the downstream upstream side in the conveyance direction of the paper sheet 900 are preferred.

As described above, in view of the conveyance stability of the paper sheet 900, the separability of the paper sheet 900 after fixing, and the increase in the gloss, the condition with the lower driving and the upward-projecting nip is preferred.

The upward-projecting nip can be achieved by setting the Asker C hardness of the pressure roller 52 higher than that of the fixing roller 51*a*. In the configuration which does not use the fixing belt 51*b* (refer to FIG. 3A), the pressure roller 52 can be caused to bite into the fixing roller 51*a* by setting the Asker C hardness of the pressure roller 52 higher than that of the fixing roller 51*a*. Thus, the upward-projecting nip can be achieved. The difference between the Asker C hardness of the pressure roller 52 and the Asker C hardness of the fixing roller 51*a* is preferably 25° or more and 80° or less. When the difference between the Asker C hardness of the pressure roller 52 and the Asker C hardness of the fixing roller 51*a* is 25° or more, the upward-projecting nip can be achieved. When the difference is 80° or less, deterioration in the durability of the rollers 51*a*, 52 can be prevented. Also in the configuration which uses the fixing belt 51*b* (refer to FIG. 3B), similarly, the difference between the Asker C hardness of the pressure roller 52 and the Asker C hardness of the fixing roller 51*a* is preferably 25° or more and 80° or less. Accordingly, it is possible to achieve the upward-projecting nip and prevent deterioration in the durability of the rollers 51*a*, 52 and the fixing belt 51*b*. On the other hand, in the configuration which uses the fixing belt 51*b*, the upward-projecting nip can be achieved also by setting the surface hardness of the fixing belt 51*b* measured at a room temperature using a type C microhardness meter to 86.0 or less. Further, in the configuration which uses the fixing belt 51*b*, the upward-projecting nip can be achieved also by setting the indentation hardness HIT as the surface hardness of the fixing belt 51*b* measured by nanoindentation to 3.5 $N/mm^2$ or less.

FIG. 6 is a graph illustrating a measurement result of the relationship between the torque of the pressure roller 52 and glossiness. The graph of FIG. 6 shows the result measured by Example 1 described later. As described later, the pressure roller 52 is caused to function as the driving member. The horizontal axis represents the torque of the pressure roller 52 indicated as the ratio (%) to a rated torque. The rated torque is torque when a motor continuously outputs a rated output at a rated voltage and a rated frequency. The vertical axis of the graph represents the glossiness of the image on the paper sheet 900 after fixing by the fixer 50 when the fixing roller 51*a* as the non-driving member is caused to perform each of the driven operation, the assist operation, and the brake operation. The torque of the pressure roller 52 is 40 [%] when the fixing roller 51*a* is caused to perform the driven operation.

As shown in FIG. 6, the gloss can be increased by both the brake operation and the assist operation. In a range where the gloss is increased by the brake operation, the glossiness monotonously increases by increasing the torque of the pressure roller 52. On the other hand, in a range where the gloss is increased by the assist operation, the glossiness does not monotonously increase even by reducing the torque of the pressure roller 52, but increases after decreasing to a minimum value with decrease in the torque of the pressure roller 52. Thus, the gloss can be increased compared to the driven operation by adding a relatively large assist to the pressure roller 52. The reason why the gloss increases by the brake operation and the assist operation is that a slight speed difference is generated between the image on the paper sheet 900 and the fixing roller 51*a*, which causes a minute shear.

FIG. 7 is a diagram illustrating an evaluation result of the increase in the gloss and side effects for each of the driven operation, the assist operation, and the brake operation of the fixing roller 51*a* as the non-driving member. The evaluation result illustrated in FIG. 7 is an evaluation result of Example 1 described later. The evaluation result is shown as a relative evaluation relative to the driven operation. As described above, when the assist in the assist operation is relatively small (refer to "Small Assist" in FIG. 7), the gloss does not increase, but decreases. The evaluation result in this case is also illustrated in FIG. 7.

As illustrated in FIG. 7, when the gloss is increased by the brake operation (refer to "Brake" in FIG. 7), the separability is good, but there is a possibility that side effects such as density unevenness of the image and a paper crease occur. These side effects may cause a problem depending on the conditions of the paper type and the image described later. On the other hand, when the gloss is increased by the assist operation (refer to "Large Assist" in FIG. 7), the side effects such as the density unevenness of the image and the paper crease can be prevented. However, when the gloss is increased by the assist operation, the separability may be deteriorated, and the deterioration in the separability may cause a problem depending on the conditions of the paper type and the image.

The controller 110 switches the non-driving member between the assist operation and the brake operation according to a predetermined condition in the high-gloss mode. The predetermined condition includes the condition of the paper type and the condition of the image. In regard to the condition of the paper type, for example, when the paper type of the paper sheet 900 is thin paper having a small basis weight and a relatively bad separability, it is possible to increase the gloss while maintaining a good separability by making a switch to the brake operation. On the other hand, when the paper type of the paper sheet 900 is thick paper having a large basis weight and a relatively good separability, it is possible to increase the gloss while preventing the occurrence of density unevenness and a paper crease by making a switch to the assist operation. The controller 110 makes a switch to the brake operation when the basis weight is less than a predetermined threshold and makes a switch to the assist operation when the basis weight is equal to or more than the predetermined threshold on the basis of the print setting included in the print data. The predetermined threshold can be appropriately determined by experiment or the like. The controller 110 may make a switch between the assist operation and the brake operation according to whether the paper type of the paper sheet 900 is plain paper or coated paper on the basis of the print setting. The condition of each paper type for the assist operation and the brake operation can be appropriately determined by experiment or the like. In regard to the condition of the image, for example, in the case where the coverage of the image (the ratio of the area of the image on the paper sheet 900 to the area of the paper sheet 900) is high and the toner adhesion amount of the image is large, the separability is relatively bad. Thus, it is possible to increase the gloss while maintaining a good separability by making a switch to the brake operation. On the other hand, in the case where the coverage of the image is low, and the toner adhesion amount of the image is small, the separability is relatively good. Thus, it is possible to increase the gloss while preventing the occurrence of density unevenness and the paper crease by making a switch to the assist operation. The condition of each image for the assist operation and the brake operation can be appropriately determined by experiment or the like.

FIG. 8 is a diagram illustrating an example of the image having a relatively high possibility of the occurrence of the paper crease when the gloss is increased by the brake mode. In the image illustrated in FIG. 8, a black area indicates an area with toner adhered, and a white area indicates an area with no toner adhered.

As illustrated in FIG. 8, in the width direction of the paper sheet 900 (the axial direction of the fixing roller 51*a* and the pressure roller 52) which is perpendicular to the conveyance direction of the paper sheet 900, when the difference between the toner adhesion amount on the center of the paper sheet 900 and the toner adhesion amount on both ends of the paper sheet 900 is relatively large, the paper crease tends to occur by performing the brake operation. Under such an image condition, it is possible to increase the gloss while preventing the occurrence of the paper crease by making a switch to the assist operation. The controller 110, for example, splits the paper sheet 900 into three in the width direction and calculates the difference between the toner adhesion amount on the center of the paper sheet 900 and the toner adhesion amount on both ends of the paper sheet 900 on the basis of the print data and the print setting which are included in the print job. When the calculated difference becomes equal to or more than a predetermined threshold, the determination for making a switch to the assist operation can be made. The predetermined threshold can be appropriately determined by experiment or the like.

When the gloss is increased in the high-gloss mode, the controller 110 may switch the degree of increasing the gloss in multiple stages by adjusting the torque of the pressure roller 52 in the assist operation or the brake operation. For example, the gloss may be increased in three stages of "+1 (a small gloss increase)", "+2 (a normal gloss increase)", and "+3 (a large gloss increase)". Such stages of the gloss increase can be included in the print setting.

The operation of the image forming apparatus 100 will be described.

Figure 9:
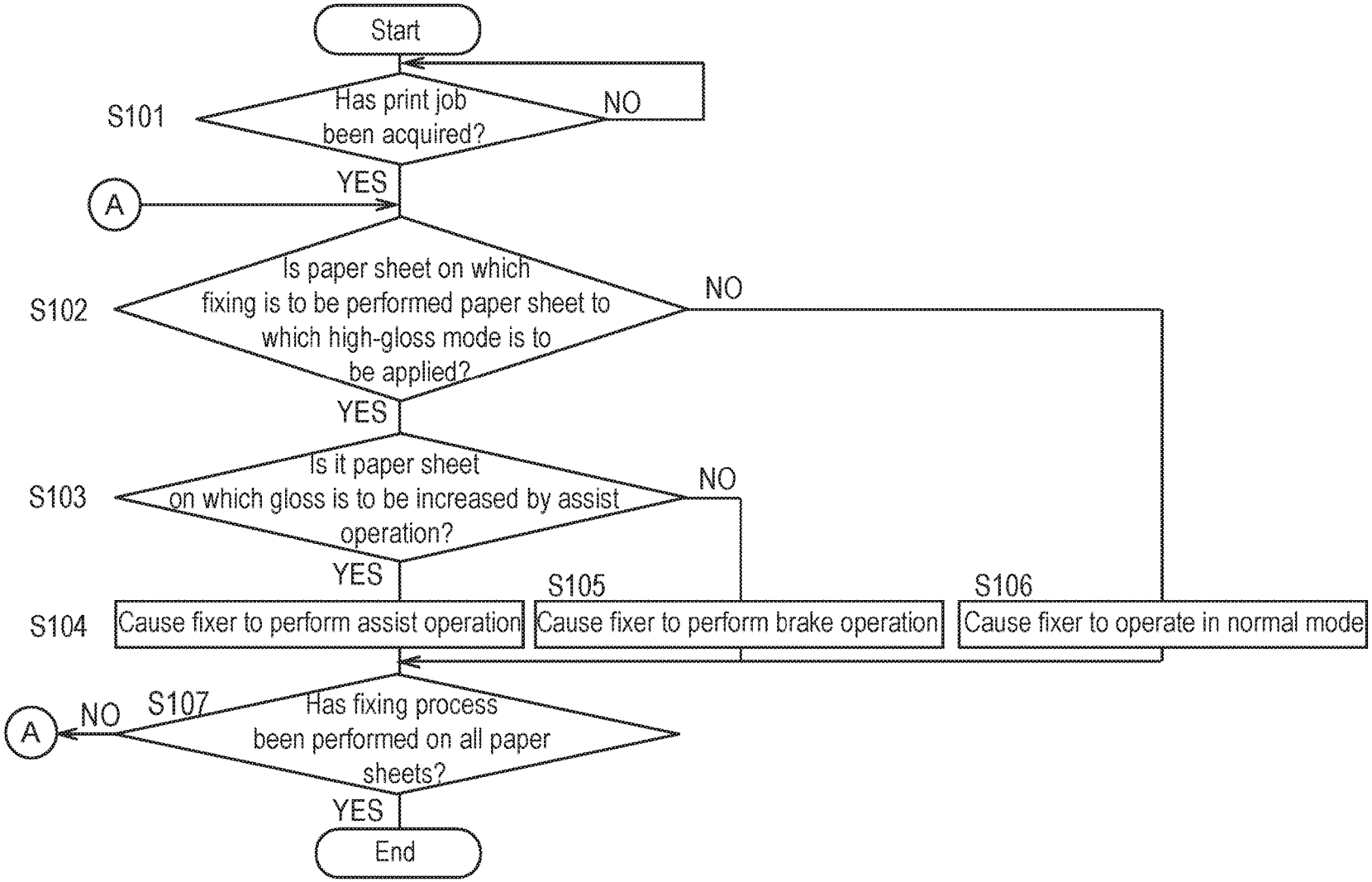
FIG. 9 is a flowchart illustrating the operation of the image forming apparatus.

FIG. 9 is a flowchart illustrating the operation of the image forming apparatus 100. The flowchart can be executed by the controller 110 in accordance with a program stored in the storage 120.

The controller 110 determines whether the print job has been acquired (S101). The controller 110, for example, can determine that the print job has been acquired when the print job has been received by the communicator 130.

The controller 110 determines whether the paper sheet 900 with the toner image formed thereon on which the fixing process by the fixer 50 is to be performed is the paper sheet 900 to which the high-gloss mode is to be applied on the basis of print setting for each paper sheet 900 included in the print job (S102).

When the controller 110 determines that the paper sheet 900 on which the fixing process is to be performed is not the paper sheet 900 to which the high-gloss mode is to be applied (S102: NO), the controller 110 causes the fixer 50 to operate in the normal mode to fix the toner image onto the paper sheet 900 (S106).

When the controller 110 determines that the paper sheet 900 on which the fixing process is to be performed is the paper sheet 900 to which the high-gloss mode is to be applied (S102: YES), the controller 110 determines whether the paper sheet 900 is the paper sheet 900 on which the gloss is to be increased by the assist operation (S103). The controller 110 can determine whether the paper sheet 900 is the paper sheet 900 on which the gloss is to be increased by the assist operation on the basis of the paper type set by the print setting included in the print job or the image formed by print data include in the print job.

When the controller 110 determines that the paper sheet 900 on which the fixing process is to be performed is the paper sheet 900 on which the gloss is to be increased by the assist operation (S103: YES), the controller 110 causes the fixer 50 to perform the assist operation to fix the toner image onto the paper sheet 900 (S104).

When the controller 110 determines that the paper sheet 900 on which the fixing process is to be performed is not the paper sheet 900 on which the gloss is to be increased by the assist operation (S103: NO), the controller 110 causes the fixer 50 to perform the brake operation to fix the toner image onto the paper sheet 900 (S105).

After the controller 10 causes the fixer 50 to perform the assist operation (S104), or to perform the brake operation (S105), or to operate in the normal mode (S106), the controller 110 determines whether the fixing process has been performed on all paper sheets 900 in the print job (S107).

When the controller 110 determines that the fixing process has been performed on all paper sheets 900 in the print job (S107: YES), the process ends. When the controller 110 determines that the fixing process has not been performed on all paper sheets 900 in the print job (S107: NO→A→S102), the controller 110 determines whether a next paper sheet 900 with the toner image formed thereon on which the fixing process by the fixer 50 is to be performed is the paper sheet 900 to which the high-gloss mode is to be applied on the basis of print setting for each paper sheet 900 included in the print job (S102), and continues the rest of the operation described above.

Example 1

The relationship between the torque of the pressure roller 52 and the glossiness was measured.

Figures 10, 11:
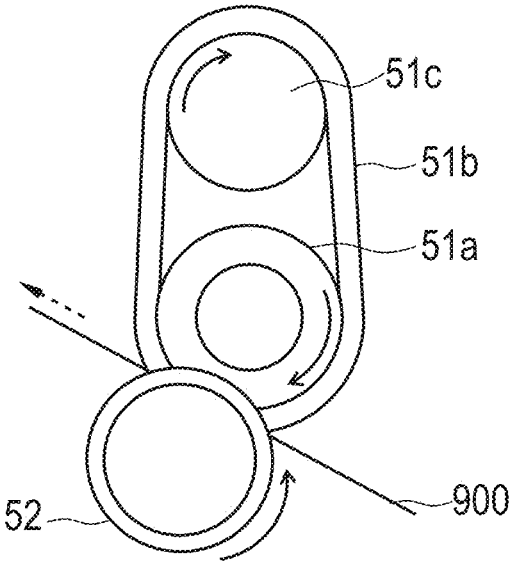
FIG. 10 is a diagram illustrating the simplified configuration of the fixer used in Example 1.
FIG. 11 is a diagram illustrating an evaluation result by Example 2.

FIG. 10 is a diagram illustrating the simplified configuration of the fixer 50 used in Example 1. In the present example, the fixer 50 including the fixing roller 51*a*, the fixing belt 51*b*, and the pressure roller 52 is used. Each of the pressure roller 52 and the fixing roller 51*a* is provided with a driving source, and the conveyance of the paper sheet 900 is driven by the pressure roller 52. A clutch is disposed between the fixing roller 51*a* and the driving source of the fixing roller 51*a*. Solid-line arrows in FIG. 10 indicate rotation directions of the fixing roller 51*a*, the heating roller 51*c*, and the pressure roller 52. A broken-line arrow indicates the conveyance direction of the paper sheet 900.

1. Measurement Conditions

Fixing roller: outer diameter ϕ70, rubber thickness 20 mm (Asker C hardness 35° (room temperature))

Pressure roller: outer diameter ϕ70, rubber thickness 3 mm (Asker C hardness 70° (room temperature))

Fixing belt: outer diameter ϕ120, base PI (70 μm thickness), rubber layer (220 μm thickness), surface layer PFA tube (30 μm thickness) (microhardness*85.0 (room temperature))

Fixing nip width: 23 mm

Paper sheet conveyance speed: approximately 460 mm/s

*The microhardness is measured using Asker MD-1 capa type C.

The glossiness is measured pursuant to JIS Z 8741 using a 75° glossmeter "micro-gloss 75°" (manufactured by BYK-Gardner).

2. Measurement and Evaluation Method (1) The clutch was disengaged so that the driving force of the driving source of the fixing roller 51*a* is not transmitted to the fixing roller 51*a*, and the fixing roller 51*a* was driven to rotate (driven) by conveying the paper sheet 900 by the pressure roller 52 (refer to "Driven" in FIG. 7). The image was fixed onto the paper sheet 900 at the fixing nip N with the fixing roller 51*a* driven to rotate, and the glossiness of the fixed image was measured as a standard for evaluation of the gloss and side effects.

(2) The pressure roller 52 was caused to function as the driving member which drives the conveyance of the paper sheet 900. A state in which the driving force of the driving source of the fixing roller 51*a* is transmitted to the fixing roller 51*a* was established by the clutch, and the linear speed of the fixing belt 51*b* was made slightly higher than the linear speed of the pressure roller 52 to cause the fixer 50 to perform the assist operation. The torque of the pressure roller 52 was reduced in stages by increasing the linear speed of the fixing belt 51*b*. The image was fixed onto the paper sheet 900 at the fixing nip N for each reduced torque. The glossiness of the fixed image was measured and evaluated together with the side effects. The evaluation was performed when the glossiness decreases by making the assist operation relatively small (refer to "Small Assist" in FIG. 7) and when the glossiness increases by making the assist operation relatively large (refer to "Large Assist" in FIG. 7).

(3) The pressure roller 52 was caused to function as the driving member which conveys the paper sheet 900. A state in which the driving force of the driving source of the fixing roller 51*a* is transmitted to the fixing roller 51*a* was established by the clutch, and the linear speed of the fixing belt 51*b* was made slightly lower than the linear speed of the pressure roller 52 to cause the fixer 50 to perform the brake operation. The torque of the pressure roller 52 was increased in stages by reducing the linear speed of the fixing belt 51*b*. The image was fixed onto the paper sheet 900 at the fixing nip N for each increased torque. The glossiness of the fixed image was measured and evaluated together with the side effects (refer to "Brake" in FIG. 7).

3. Result

A measurement result by the present example is as shown in FIG. 6, and an evaluation result is as shown in FIG. 7.

The present example has proved that the gloss is increased by both the brake operation and the assist operation. Further, it has been proved that the occurrence of the crease on the paper sheet 900 and the occurrence of density unevenness are prevented by causing the fixer 50 to perform the assist operation.

Example 2

In Example 1, the pressure roller 52, which does not come into contact with the toner image on the paper sheet 900, was caused to function as the driving member. In the present example, the fixing belt 51*b*, which comes into contact with the toner image on the paper sheet 900, was caused to function as the driving member, and the increase in the gloss and side effects were evaluated for each of the driven operation, the assist operation, and the brake operation.

1. Measurement Conditions

Measurement conditions of the present example are the same as those of Example 1 except that a clutch is disposed not between the fixing roller 51*a* and the driving source of the fixing roller 51*a*, but disposed between the pressure roller 52 and the driving source of the pressure roller 52.

2. Evaluation Method (1) The clutch was disengaged so that the driving force of the driving source of the pressure roller 52 is not transmitted to the pressure roller 52, and the pressure roller 52 was driven to rotate (driven) by conveying the paper sheet 900 by the fixing belt 51*b* (refer to "Driven 2" in FIG. 11). The image was fixed onto the paper sheet 900 at the fixing nip N with the pressure roller 52 driven to rotate, and the glossiness of the fixed image was measured as a standard for evaluation of the gloss and the side effects.

(2) The fixing belt 51*b* was caused to function as the driving member which drives the conveyance of the paper sheet 900. A state in which the driving force of the driving source of the pressure roller 52 is transmitted to the pressure roller 52 was established by the clutch, and the linear speed of the pressure roller 52 was made slightly higher than the linear speed of the fixing belt 51*b* to cause the fixer 50 to perform the assist operation. The torque of the fixing belt 51*b* (that is, the fixing roller 51*a*) was reduced in stages by increasing the linear speed of the pressure roller 52. The image was fixed onto the paper sheet 900 at the fixing nip N for each reduced torque. The glossiness of the fixed image was measured and evaluated together with the side effects. The evaluation was performed when the glossiness decreases by making the assist operation relatively small (refer to "Small Assist 2" in FIG. 11) and when the glossiness increases by making the assist operation relatively large (refer to "Large Assist 2" in FIG. 11).

(3) The fixing belt 51*b* was caused to function as the driving member which drives the conveyance of the paper sheet 900. A state in which the driving force of the driving source of the pressure roller 52 is transmitted to the pressure roller 52 was established by the clutch, and the linear speed of the pressure roller 52 was made slightly lower than the linear speed of the fixing belt 51*b* to cause the fixer 50 to perform the brake operation. The torque of the fixing belt 51*b* (that is, the fixing roller 51*a*) was increased in stages by reducing the linear speed of the pressure roller 52. The image was fixed onto the paper sheet 900 at the fixing nip N for each increased torque. The glossiness of the fixed image was measured and evaluated together with the side effects (refer to "Brake 2" in FIG. 11).

3. Result

FIG. 11 is a diagram illustrating the evaluation result of the present example.

The comparison between the evaluation result of the present example and the evaluation result of Example 1 shows that the side effects are inversed. Thus, it is possible to increase the gloss of the image on the paper sheet 900 while preventing the side effects such as the occurrence of the crease on the paper sheet 900 by making the switch (selective use) between the assist operation and the brake operation in the configuration of Example 2 opposite to the switch between the assist operation and the brake operation in the configuration of Example 1.

The above embodiment achieves the following effects.

One member, either the fixing member which comes into contact with an unfixed image on a recording medium at the fixing nip or the pressure member which is pressed against the fixing member, is caused to function as the driving member which conveys the recording medium in the normal mode, and the other member of the pressure member and the fixing member is caused to operate the assist operation for reducing torque of the driving member compared to the normal mode in the high-gloss mode. Accordingly, it is possible to increase the gloss of the image on the recording medium while preventing side effects such as the occurrence of the crease on the recording medium.

Further, either the pressure member or the fixing member other than the driving member is caused to perform either the assist operation or the brake operation for increasing the torque of the driving member compared to the normal mode to increase the gloss of the image in the high-gloss mode. Accordingly, it is possible to effectively increase the gloss of the image on the recording medium while preventing the side effects.

Further, either the pressure member or the fixing member other than the driving member is switched between the assist operation and the brake operation according to the predetermined condition. Accordingly, it is possible to more effectively increase the gloss of the image on the recording medium while preventing the side effects.

Further, the pressure member is caused to function as the driving member. Accordingly, the stability of the paper sheet conveyance can be improved.

Further, each of the pressure member and the fixing member is the roller, and the Asker C hardness of the pressure member is higher than the Asker C hardness of the fixing member. Accordingly, the fixing nip can be formed in the shape projecting toward the fixing member. Thus, when the recording medium is ejected from the fixing nip, the recording medium is ejected in the direction away from the fixing member which comes into contact with the unfixed image on the recording medium. Thus, it is possible to improve the separability and prevent the winding of the recording medium around the fixing member.

Further, the fixing member is the fixing belt, the pressure member and the fixing roller are pressed against each other through the fixing belt to form the nip portion between the fixing belt and the pressure member, and the Asker C hardness of the pressure member is higher than the Asker C hardness of the fixing roller. Accordingly, the fixing nip can be formed in the shape projecting toward the fixing member. Thus, when the recording medium is ejected from the fixing nip, the recording medium is ejected in the direction away from the fixing member which comes into contact with the unfixed image on the recording medium. Thus, it is possible to improve the separability and prevent the winding of the recording medium around the fixing member.

Further, the difference in hardness between the pressure member and the fixing member or the difference in hardness between the pressure member and the fixing roller is 25° or more and 80° or less. Accordingly, the shape of the fixing nip projects toward to the fixing member. Thus, it is possible to improve the separability and improve the durability of the pressure member and the fixing member.

Further, the predetermined condition includes the condition of the paper type. Accordingly, it is possible to easily and effectively increase the gloss of the image on the recording medium while preventing the side effects such as the occurrence of the crease on the recording medium, the occurrence of density unevenness, and the winding of the recording medium around the fixing member.

Further, the predetermined condition includes the condition of the image. Accordingly, it is possible to easily and effectively increase the gloss of the image on the recording medium while preventing the side effects such as the occurrence of the crease on the recording medium, the occurrence of density unevenness, and the winding of the recording medium around the fixing member.

Further, either the pressure member or the fixing member other than the driving member is caused to perform the brake operation when the fixing separability is made to improved. Accordingly, it is possible to more effectively prevent the side effect of the winding of the recording medium around the fixing member by giving a higher priority to the fixing separability than the side effects such as the occurrence of the crease on the recording medium and the occurrence of density unevenness.

Further, either the pressure member or the fixing member other than the driving member is caused to perform the assist operation when the crease on the recording medium is made to prevent. Accordingly, it is possible to further improve the effect of preventing the occurrence of the crease on the recording medium.

Further, either the pressure member or the fixing member other than the driving member is caused to perform the assist operation when the density unevenness of the image formed on the recording medium is made to prevent. Accordingly, it is possible to further improve the effect of preventing the occurrence of density unevenness on the recording medium.

Further, the fixing member is the fixing belt, and the surface hardness measured at the room temperature using the type C microhardness meter is 86.0 or less. Accordingly, since the gloss increase in the assist operation can be made large when a relatively soft fixing belt is used, it is possible to more appropriately make a switch between the assist operation and the brake operation.

Further, the fixing member is the fixing belt, and the indentation hardness HIT as the surface hardness of the fixing belt measured by nanoindentation is 3.5 $N/mm^2$ or less. Accordingly, since the gloss increase in the assist operation can be made large when a relatively soft fixing belt is used, it is possible to more appropriately make a switch between the assist operation and the brake operation.

The present invention is not limited to the above embodiment.

For example, in the embodiment, the paper sheet is described as an example of the recording medium. However, the recording medium is not limited to the paper sheet, and may be a resin film or the like.

Further, a powder brake may be used instead of the clutch used in the embodiment.

Further, an endless pressure belt may be stretched on the pressure roller 52 to form the fixing nip N between the pressure belt and the fixing roller 51*a*. When the fixing belt 51*b* is used, the fixing nip N may be formed between the pressure belt and the fixing belt 51*b*.

Further, setting of the high-gloss mode and the setting of stages of the gloss increase may be performed by an input to the operation display 140 by a user. These setting can be reflected in the print setting included in the print job.

Further, some or all of the processes executed by the program in the embodiment can be replaced with and executed by hardware such as circuits.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus comprising:

an image former which forms an image on a recording medium;

a pressure member;

a fixing member which is pressed against the pressure member to form a nip portion and comes into contact with the image formed on said recording medium conveyed at said nip portion; and a hardware processor which causes one member, which is either the pressure member or the fixing member, to function as a driving member which conveys the recording medium in a normal mode and causes the other member of the pressure member and the fixing member to perform an assist operation for reducing torque of the driving member compared to the normal mode to increase gloss of the image in a high-gloss mode.

2. The image forming apparatus according to claim 1, wherein the hardware processor causes the other member to perform either the assist operation or a brake operation for increasing torque of the driving member compared to the normal mode to increase gloss of the image in the high-gloss mode.

3. The image forming apparatus according to claim 2, wherein the hardware processor switches the other member between the assist operation and the brake operation according to a predetermined condition.

4. The image forming apparatus according to claim 3, wherein the predetermined condition includes at least one of a condition of a paper type and a condition of the image.

5. The image forming apparatus according to claim 2, wherein said the other member is caused to perform the brake operation under a condition that fixing separability should be improved.

6. The image forming apparatus according to claim 1, wherein the pressure member is caused to function as the driving member.

7. The image forming apparatus according to claim 6, wherein each of the pressure member and the fixing member is a roller, and an Asker C hardness of the pressure member is higher than an Asker C hardness of the fixing member.

8. The image forming apparatus according to claim 7, wherein a difference in Asker C hardness between the pressure member and the fixing member is at least 25° and not more than 80°.

9. The image forming apparatus according to claim 6, wherein the fixing member is a fixing belt, the pressure member and a fixing roller disposed on an inner peripheral face of the fixing belt are pressed against each other through the fixing belt to form the nip portion between the fixing belt and the pressure member, and an Asker C hardness of the pressure member is higher than an Asker C hardness of the fixing roller.

10. The image forming apparatus according to claim 9, wherein a difference in Asker C hardness between the pressure member and the fixing roller is at least 25° and not more than 80°.

11. The image forming apparatus according to claim 6, wherein said the other member is caused to perform the assist operation under a condition that a crease on the recording medium should be prevented.

12. The image forming apparatus according to claim 6, wherein the other member is caused to perform the assist operation under a condition that density unevenness of the image formed on the recording medium should be prevented.

13. The image forming apparatus according to claim 1, wherein the fixing member is a fixing belt, and a surface hardness of the fixing belt measured at room temperature using a type C microhardness meter is 86.0 or less.

14. The image forming apparatus according to claim 1, wherein the fixing member is a fixing belt, and an indentation hardness HIT as a surface hardness of the fixing belt measured by nanoindentation is 3.5 $N/mm^2$ or less.

* * * * *